US005423208A

United States Patent [19]

Dudek et al.

[11] Patent Number: 5,423,208

[45] Date of Patent: Jun. 13, 1995

[54] AIR DYNAMICS STATE CHARACTERIZATION

[75] Inventors: Kenneth P. Dudek, Rochester Hills; Gregory P. Matthews, Bloomfield Hill; Charles H. Folkerts, Troy; Ronald A. Davis, Commerce Township, Oakland County, all of Mich.

[73] Assignee: General Motors Corporation, Detroit, Mich.

[21] Appl. No.: 155,263

[22] Filed: Nov. 22, 1993

[51] Int. Cl.[6] ..... F02B 3/00

[52] U.S. Cl. ..... 73/117.3; 73/118.2; 123/478; 123/492; 123/571; 364/431.05; 364/565

[58] Field of Search ..... 73/118.2, 117.3; 123/478, 492, 571; 364/431.05, 565

[56] References Cited

U.S. PATENT DOCUMENTS 4,245,604 1/1981 Lahiff ..... 123/478

4,447,880 5/1984 Kasai et al. ..... 364/431.05

*Primary Examiner*—Herbert Goldstein

*Assistant Examiner*—Jewel V. Artis

*Attorney, Agent, or Firm*—Michael J. Bridges

[57] ABSTRACT

The state of internal combustion engine inlet air dynamics is characterized in a substantially noise immune albeit rapid manner according to the degree by which a first set of criteria indicate a steady state condition in which engine inlet air rate substantially corresponds to cylinder inlet air rate or to the degree by which a second set of criteria indicate a transient condition in which engine inlet air rate does not substantially correspond to cylinder air rate. Cylinder inlet air rate may then be predicted in accord with the characterization.

16 Claims, 4 Drawing Sheets

AIR DYNAMICS STATE CHARACTERIZATION

FIELD OF THE INVENTION

The present invention relates to internal combustion engine air/fuel control and, more specifically, to characterization of the state of internal combustion engine inlet air dynamics for cylinder inlet air rate prediction.

BACKGROUND OF THE INVENTION

Internal combustion engine air/fuel ratio control is known in which fuel command magnitude is determined in response to an estimate of the magnitude of an operator-controlled engine inlet air rate. Such control may be termed "air-lead" control. If fuel is controlled to individual cylinders, such as through conventional port fuel injection, the corresponding air rate of the cylinders must be estimated and the fuel command determined in response thereto to provide a desirable air/fuel ratio to the cylinders.

A desirable engine air/fuel ratio may be the well-known stoichiometric air/fuel ratio. Efficient reduction of undesirable engine exhaust gas constituents through conventional catalytic treatment thereof occurs when the engine air/fuel ratio is the stoichiometric ratio. Even minor deviations away from the stoichiometric ratio can degrade emissions reduction efficiency significantly. Accordingly, it is important that the engine air/fuel ratio be closely controlled to the stoichiometric ratio.

The precision of the described air-lead control is limited by the precision of the cylinder inlet air rate sensing or estimation. When engine inlet air dynamics are in steady state, such that the air pressure in the engine intake manifold is substantially constant over a predetermined time period, precise cylinder inlet air rate sensing may be provided through use of a conventional mass airflow meter in the engine inlet air path. The absence of any significant manifold filling or depletion in steady state provides for a direct correspondence between manifold inlet air rate and cylinder inlet air rate. Accordingly, the airflow meter may alone be used for accurate cylinder inlet air rate estimation in steady state.

The airflow meter may not accurately characterize cylinder inlet air rate under transient conditions, such as conditions in which there is no direct correspondence between manifold inlet air rate and cylinder inlet air rate. This is primarily due to the significant time constant associated with manifold filling or depletion, and airflow meter lag. Transient conditions can arise rapidly during engine operation, such as by any substantial change in engine inlet throttle position TPOS, or by any other condition that perturbs manifold absolute pressure MAP. Any significant perturbation in steady state operating conditions will rapidly inject substantial error in the airflow meter estimate of cylinder inlet air rate. Accordingly, if a mass airflow meter is to be used for cylinder air rate estimation under steady state operation, some variation in the estimation approach is required to retain estimation accuracy when outside steady state operation. Necessarily, there must be a reliable determination of whether the engine is operating in steady state or under transient conditions.

Engine parameters such as engine intake manifold absolute pressure MAP and air inlet valve position TPOS may be used to categorize the air dynamics as steady state or transient. The lack of manifold filling or depletion that characterizes steady state air dynamics is directly indicated by a substantially steady MAP over a predetermined number of MAP samples. Such provides sufficient information with which to diagnose an entry into steady state. It has been proposed to use one criterion, such as the described substantially steady MAP criterion to detect or diagnose both entry into and exit from steady state. Two difficulties result from the use of a single criteria with which to transition into or out of steady state air dynamics. First, signal noise may trigger unnecessary transitions. Second, detection of transitions, especially out of steady state, may be delayed while waiting for detailed analyses, such as analyses designed to reduce sensitivity to noise, to come to a conclusion.

Signal noise may come from a sensor, such as a MAP or TPOS sensor, or may result from analog to digital signal conversion quantization effects. The noise may cause misleading variations in the interpreted signal, leading to false indications of MAP or TPOS variation, and thus to an improper diagnosis that the air dynamics are no longer in steady state. Such may reduce cylinder air rate estimation accuracy.

If detection of a transition is delayed, especially a transition out of steady state, cylinder inlet air rate estimation accuracy may be degraded. For example, a significant number of MAP or TPOS samples may be required to determine if indeed the manifold is not filling or depleting—indicating steady state operation. Once in steady state, mass airflow meter information may accurately characterize cylinder inlet air rate. However, a slight change in MAP or TPOS may quickly erode the accuracy of the characterization by rapidly leading to accumulation or depletion in the manifold. A cylinder inlet air rate estimation penalty is incurred during the period of time required for accumulation and interpretation of MAP or TPOS signals so as to diagnose the exit from steady state. Accordingly, the duration of such a time period should be minimized.

It therefore would be desirable to provide a characterization of engine inlet air dynamics that is substantially insensitive to signal noise and yet rapidly detects entry into or exit out of a steady state condition, so the appropriate cylinder air rate estimation approach may be applied at all times during engine operation, for precise engine air/fuel ratio control.

SUMMARY OF THE INVENTION

The present invention provides the desirable engine air/fuel ratio control benefit by applying a variety of dynamic criteria in an analysis of engine inlet air dynamics to significantly reduce the sensitivity of the analysis to noise, and yet to rapidly characterize the air dynamics, especially when the air dynamics are exiting steady state.

Specifically, a first set of criteria is provided that vary with expected signal noise levels, such as noise levels that vary with engine operating conditions. This first set of criteria is precisely selected as indicating a state of air dynamics in which a mass airflow meter-based cylinder air rate estimation approach will provide precise cylinder inlet air rate information, and is applied to engine operating parameters to diagnose the presence of steady state.

Once steady state dynamics are diagnosed as present, the first set of criteria do not operate. Rather, a second set of criteria, also varying with expected signal noise levels is applied to detect an exit from steady state. This second set of criteria is selected to provide rapid detection of the presence of any operating condition which should provide significant manifold filling or depletion. A diagnosis made under the second set of criteria need not take the time required under the first set of criteria. Once diagnosed to be out of steady state, the second set of criteria do not operate, and the first set become active to diagnose entry back into steady state.

Through selective application of the first and second sets of criteria, a cylinder inlet air rate estimation approach with high noise immunity is provided. A diagnosis of steady state air dynamics is made when cylinder inlet air rate estimation can benefit from a steady state approach, such as an approach responsive to a mass airflow sensor signal. Diagnosis of a departure from steady state is made rapidly upon detection of any condition that may deteriorate the accuracy of the steady state inlet air rate estimation approach. The enhanced noise immunity reduces transitioning into and out of a diagnosed steady state condition, further ensuring that the applied cylinder inlet air rate estimation approach will properly correspond to the state of the air dynamics.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
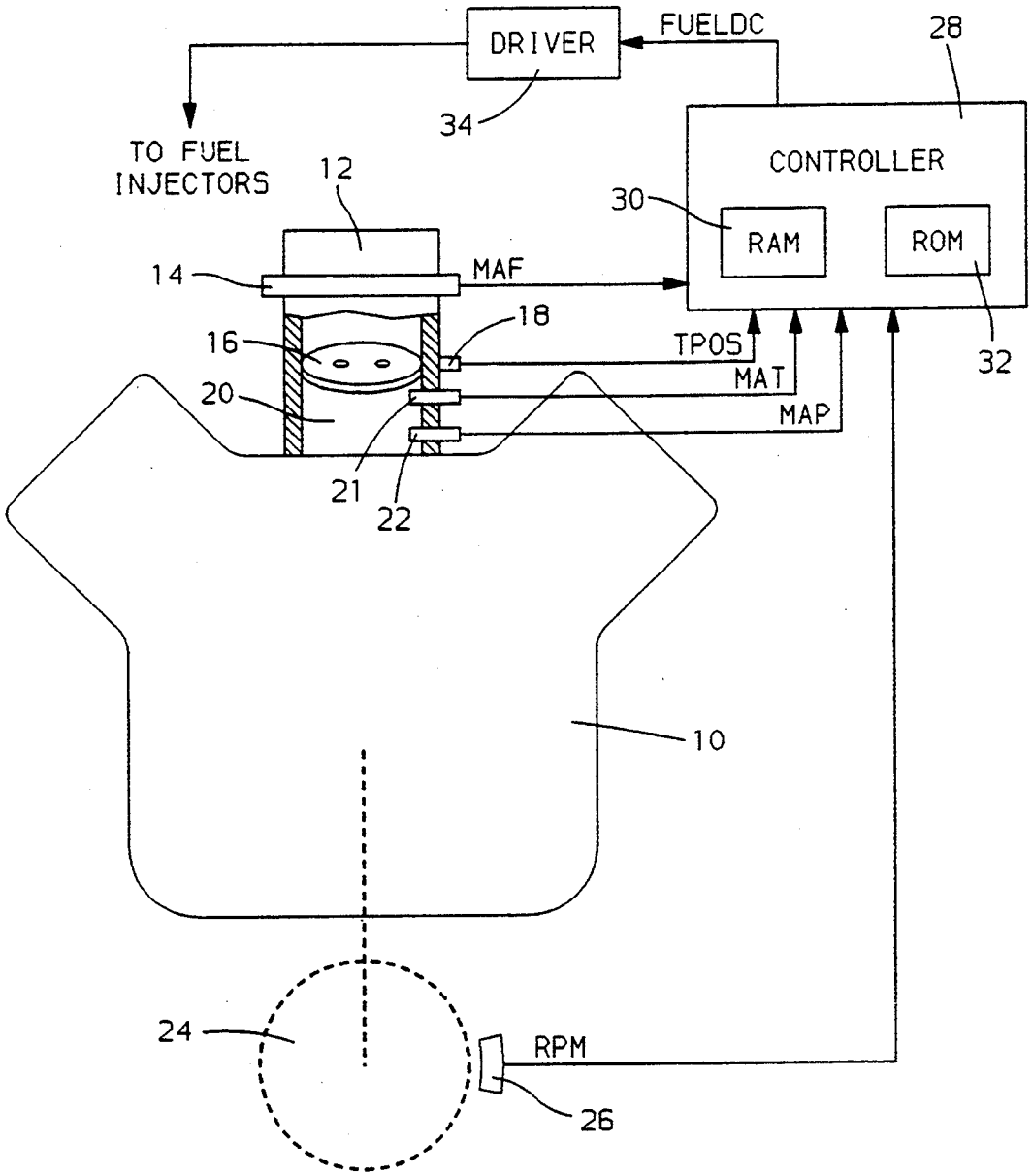
FIG. 1 is a general diagram of an engine and engine control hardware used in accord with the preferred embodiment of the invention.

Referring to FIG. 1, air is provided to an internal combustion engine 10 through inlet air path commencing at inlet 12, and is passed from inlet 12 through mass airflow sensing means 14, such as a conventional mass airflow meter, which provides an output signal MAF indicative of the rate at which air passes through the sensing means.

The inlet air is metered to the engine 10 via throttle valve 16, such as may be a conventional butterfly valve which rotates within the inlet air path in accord with an operator commanded engine operating point. The rotational position of the valve is transduced via throttle position sensor 18, which may be a generally known rotational potentiometer which communicates an output signal TPOS indicative of the rotational position of the valve 16.

A manifold pressure sensor 22 is disposed in the inlet air path 20 such as in an engine intake manifold between the throttle valve 16 and the engine 10, to transduce manifold absolute air pressure and communicate output signal MAP indicative thereof. A manifold air temperature sensor 21 is provided in the inlet air path 20 such as in the engine intake manifold to sense air temperature therein and communicate a signal MAT indicative thereof.

Engine output shaft 24, such as an engine crankshaft, rotates through operation of the engine 10 at a rate proportional to engine speed. Appendages or teeth (not shown) are spaced about a circumferential portion of the shaft 24. A tooth passage sensing means 26, such as a conventional variable reluctance sensor is positioned with respect to the crankshaft teeth so as to sense passage of the teeth by the sensor. The teeth may be spaced about the circumference of the shaft 24 such that each passage of a tooth by the sensing means 26 corresponds to an engine cylinder event.

For example, in a four cylinder, four stroke engine, the shaft 24 may include two teeth equally spaced about the shaft circumference, such as 180 degrees apart. Additional teeth may be included for synchronization of the teeth, as is generally understood in the engine control art. Sensing means 26 provides an output signal RPM having a frequency proportional to engine speed in that each cycle of RPM may indicate a cylinder event of engine 10.

Controller 28, such as a conventional 32 bit microcontroller, including conventional random access memory RAM 30 and conventional read only memory ROM 32, receives input signals including the described MAF, TPOS, MAP, MAT and RPM, and determines engine control commands in response thereto, to provide for control of engine operation, such as in a manner consistent with generally known engine control practices.

For example, the input information may be applied in an estimation of engine inlet air rate which may be used in a prediction of cylinder inlet air rate. The prediction then is applied in a determination of cylinder fueling requirements consistent with a desired engine air/fuel ratio such as the well-known stoichiometric ratio. A commanded duty cycle FUELDC may then be generated representing of duration of opening of appropriate fuel injectors (not shown) so as to deliver the required fuel to active engine cylinders. FUELDC may be periodically output to one or more fuel injector drivers 34 which transform FUELDC into a command suitable to open an appropriate fuel injector for the duty cycle duration.

In the present embodiment, such engine control is provided as illustrated in FIGS. 2–5. The steps illustrated in the routines of FIGS. 2–5 may correspond to controller instructions, such as may be stored in ROM 32 and accessed therefrom in a step-by-step manner as required while the controller 28 operates. Such controller operations in general are intended to be consistent with well-known practice in electronic controller-based engine control.

Figure 2:
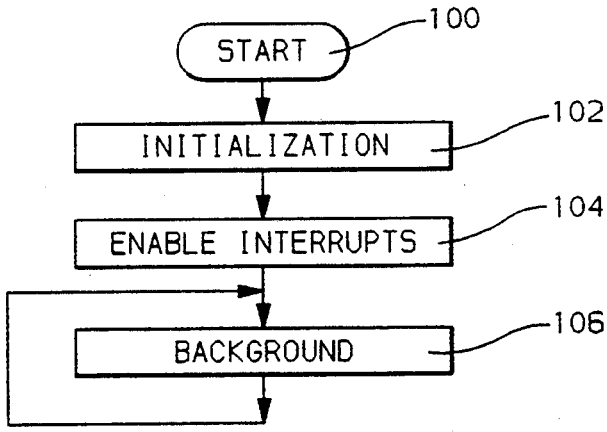
FIGS. 2–5 are computer flow diagrams illustrating steps used to carry out the invention in accord with the preferred embodiment.

Specifically, when engine control is to commence, such as when the engine is started through application of ignition power to the engine 10 and controller 28 by the engine operator, the routine of FIG. 2 is entered at step 100. The routine moves to step 102, to provide for system initialization, such as through setting flags, counters, and pointers to initial values, and by transferring data constants from ROM 32 to RAM 30, for use in engine control.

Next, the routine moves to a step 104, to enable conventional interrupts as may be needed in the engine control of the present embodiment. Such interrupts may include both timer-based and event-based interrupts. Among the interrupts enabled at step 104 is an crankshaft event-based interrupt. This interrupt is set up to occur once for each period of the signal RPM, or equivalently once per cylinder event of engine 10, such as when signal RPM crosses a predetermined threshold.

After enabling interrupts at step 104, the routine of FIG.2 moves to background operations represented by step 106, which are to be continuously repeated while the controller 28 is operating. Included in the background operations may be conventional diagnostics or maintenance routines. Upon occurrence of a control interrupt, such as an interrupt enabled at step 104, the background operations of step 106 will be temporarily suspended while a service routine corresponding to the interrupt is executed. Upon completion of the service routine, the background operations may resume, as is generally understood in the art of engine control.

Figure 3:
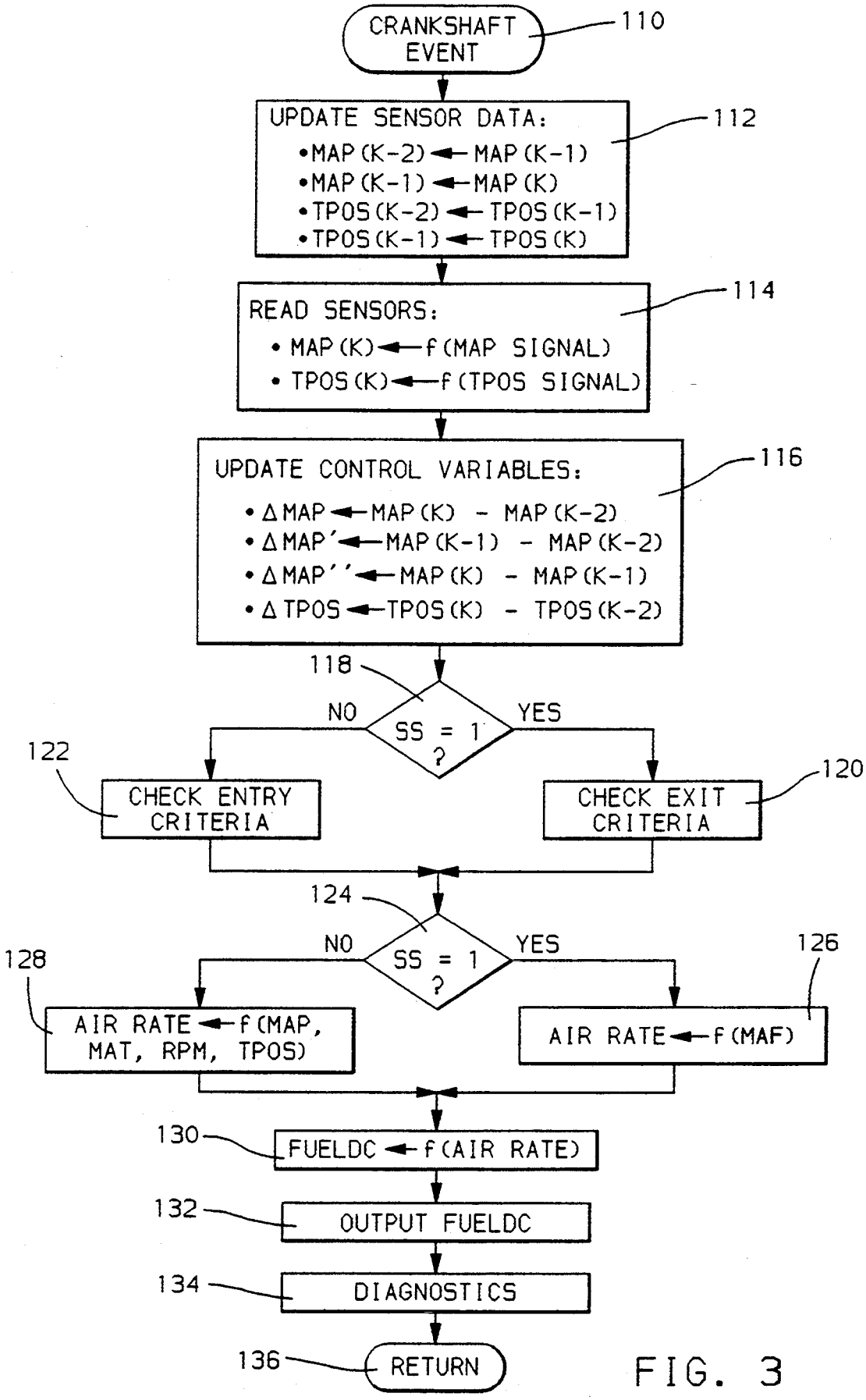

The service routine corresponding to the crankshaft interrupt enabled at step 104 to occur once for each engine cylinder event is illustrated by FIG. 3, and is entered on the occurrence of each crankshaft event at step 110. The routine proceeds to a step 112, to update sensor data as follows $$MAP(K-2) \leftarrow MAP(K-1)$$

$$MAP(K-1) \leftarrow MAP(K)$$

$$TPOS(K-2) \leftarrow TPOS(K-1)$$

$$TPOS(K-1) \leftarrow TPOS(K)$$

in which MAP(K) is sensed manifold absolute pressure MAP at a Kth cylinder event, and TPOS(K) is sensed throttle position TPOS at a Kth cylinder event.

In this manner, information on sensed MAP and TPOS two events prior to the present cylinder event are stored as MAP(K−2) and TPOS(K−2) respectively, and information on sensed MAP and TPOS one event prior to the present event are stored as MAP(K−1) and TPOS(K−1), respectively.

Next, the routine moves to a step 114, to read, condition, such as through well-known signal filtering processes, and store information on MAP and TPOS for the present cylinder event as MAP(K) and TPOS(K) respectively.

The routine then, at step 116, computes control variables needed for the air dynamics characterization of the present embodiment as follows $$\Delta MAP \leftarrow MAP(K) - MAP(K-2)$$

$$\Delta MAP' \leftarrow MAP(K-1) - MAP(K-2)$$

$$\Delta MAP'' \leftarrow MAP(K) - MAP(K-1)$$

$$\Delta TPOS \leftarrow TPOS(K) - TPOS(K-2).$$

The routine then advances to a step 118, to analyze the state of a flag SS indicating the most recent prior characterization of the state of the air dynamics. SS may be stored in controller RAM 30 (FIG. 1) and is cleared at the initialization step 102 of the routine of FIG. 2. A characterization of steady state air dynamics in accord with the present embodiment is indicated by setting SS to one, and a characterization of transient air dynamics is indicated by setting SS to zero.

Figure 4:
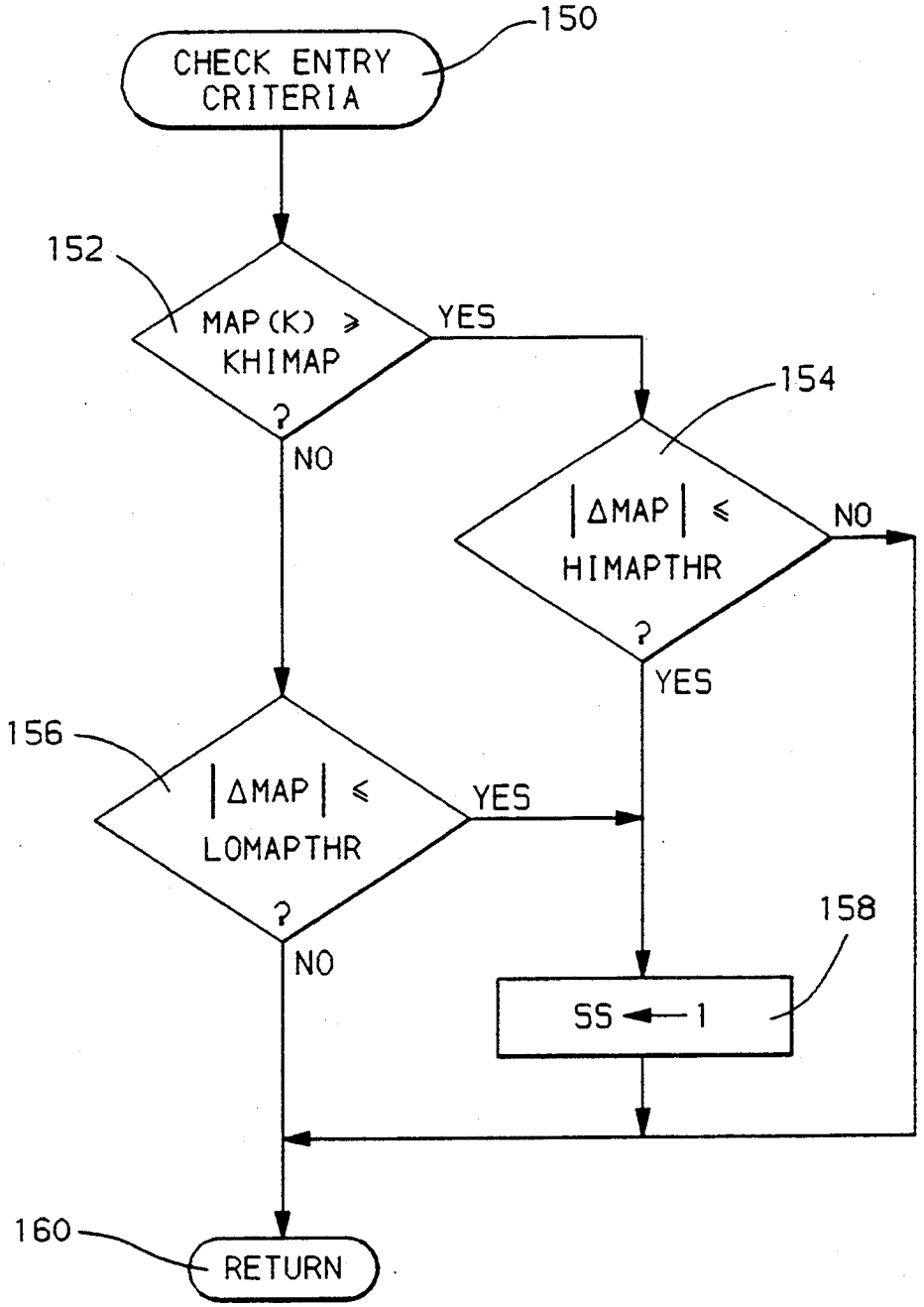

In accord with the present invention, if SS is not set to one at step 118 of FIG. 3, indicating the air dynamics are currently diagnosed as being in a transient condition, a particularized set of criteria are applied to detect an entry into steady state by moving to a step 122 to check entry criteria, as will be further detailed in FIG. 4. Alternatively, if SS is set to one at step 118, indicating air dynamics are currently diagnosed as being in a steady state condition, a particularized set of criteria are applied to rapidly detect an exit out of steady state by moving to a step 120 to check exit criteria, as will be further detailed in FIG. 5.

The entry criteria are particularized to reliably detect entry into steady state and are applied in a manner substantially insensitive to signal noise. The exit criteria focus on a rapid detection of any break in the conditions establishing steady state so that steady state cylinder air rate estimation techniques may be abandoned as soon as the accuracy thereof may be degraded.

Following the check of entry criteria at step 122 or the check of exit criteria at step 120, the routine of FIG. 3 moves to a step 124, to again poll the flag SS, which may be updated through one of steps 120 or 122. If SS is set to one at step 124, indicating the air dynamics are presently determined to be in steady state, the routine moves to step 126, to determine cylinder inlet air rate as a function of mass airflow MAF, such as from the signal output from mass airflow sensing means 14 (FIG. 1). For example, conventional light filtering of the signal MAF may provide an acceptably conditioned indication of the cylinder inlet air rate.

Alternatively, if SS is determined to be zero at step 124, cylinder inlet air dynamics are presently estimated to be in a transient condition, and the routine moves to a step 128 to determine cylinder inlet air rate as a function of such conventionally known information as manifold absolute pressure MAP, manifold air temperature MAT, engine speed as indicated by signal RPM, manifold air temperature MAT, or air inlet valve position TPOS. For example, known speed density techniques may be used at step 128 to estimate cylinder inlet air rate.

After determining cylinder inlet air rate at either of steps 126 or 128, the routine moves to a step 130 to determine a fuel command FUELDC corresponding to the determined cylinder inlet air rate, such as to attempt to maintain a desired cylinder inlet air/fuel ratio, which may be the stoichiometric ratio. FUELDC may be a duty cycle applied as a fixed frequency, fixed magnitude variable duty cycle command issued to an active one of a set of port fuel injectors of the engine through an injector driver 34 (FIG. 1), as described.

After determining an appropriate magnitude of FUELDC, the routine moves to a step 132 to output FUELDC, such as to the driver 34 (FIG. 1), which may issue the command to an active fuel injector (not shown), for example the injector from the set of injectors of the engine that resides in proximity to an intake port of a cylinder currently in a predetermined stroke, such as an exhaust stroke, as indicated by absolute engine position information.

The routine then moves to a step 134, which is meant to represent any other operations necessary under conventional engine control practice to be carried out in the crankshaft interrupt service routine, such as engine control diagnostics routines. After any of such conventional operations that are required are carried out at the step 134, the routine returns to the background operations that were interrupted by the crankshaft interrupt, via step 136.

FIG. 4 illustrates steady state entry criteria to be applied when not in steady state to reliably detect an entry into steady state. The criteria are designed to provide a substantially noise immune diagnosis of engine operating conditions under which accurate cylinder inlet air rate estimation may be provided through mass airflow sensing alone, while not injecting any significant delay in the diagnosis.

Generally, a variable threshold is compared to ΔMAP to determine if the magnitude of any change in sensed manifold absolute pressure over the most recent two engine cylinder events is significant. The threshold of the present embodiment is calibrated to be small for low MAP values and larger for high MAP values, to account for variation in MAP signal noise. Alternative embodiments within the scope of this invention may vary threshold in various ways to account for measurements of MAP signal noise over varying engine operating conditions.

Specifically the routine of FIG. 4 is invoked at step 122 of FIG. 3, and starts at step 150 of FIG. 4. The routine proceeds to a step 152 to compare MAP(K) to a predetermined MAP threshold KHIMAP which may be set to a calibrated value, such as a value corresponding to 84 kPa in this embodiment. If MAP(K) exceeds or is equal to KHIMAP at step 152, the routine moves to step 154 to compare MAP magnitude stability, as represented by the magnitude of ΔMAP, to HIMAPTHR, a predetermined high MAP threshold value, set to a value representing about 0.67 kPa in this embodiment. If the magnitude of ΔMAP does not exceed this threshold, the routine moves to step 158 to set flag SS to one. After step 158, the routine moves to step 160, to return to the operations of the routine of FIG. 3. If the magnitude of ΔMAP does exceed the threshold at step 154, SS remains at zero by moving directly to step 160.

Alternatively at step 152, if MAP(K) is less than KHIMAP, the routine moves to step 156 to compare the stability of MAP magnitude represented by the magnitude of ΔMAP to LOMAPTHR, a predetermined low MAP threshold value, set to zero in this embodiment. If the magnitude of ΔMAP does not exceed this threshold, flag SS is set to one at step 158, after which the routine ends at step 160. If, at step 156, the magnitude of ΔMAP does exceed LOMAPTHR, SS remains at zero by moving directly to step 160.

Figure 5:
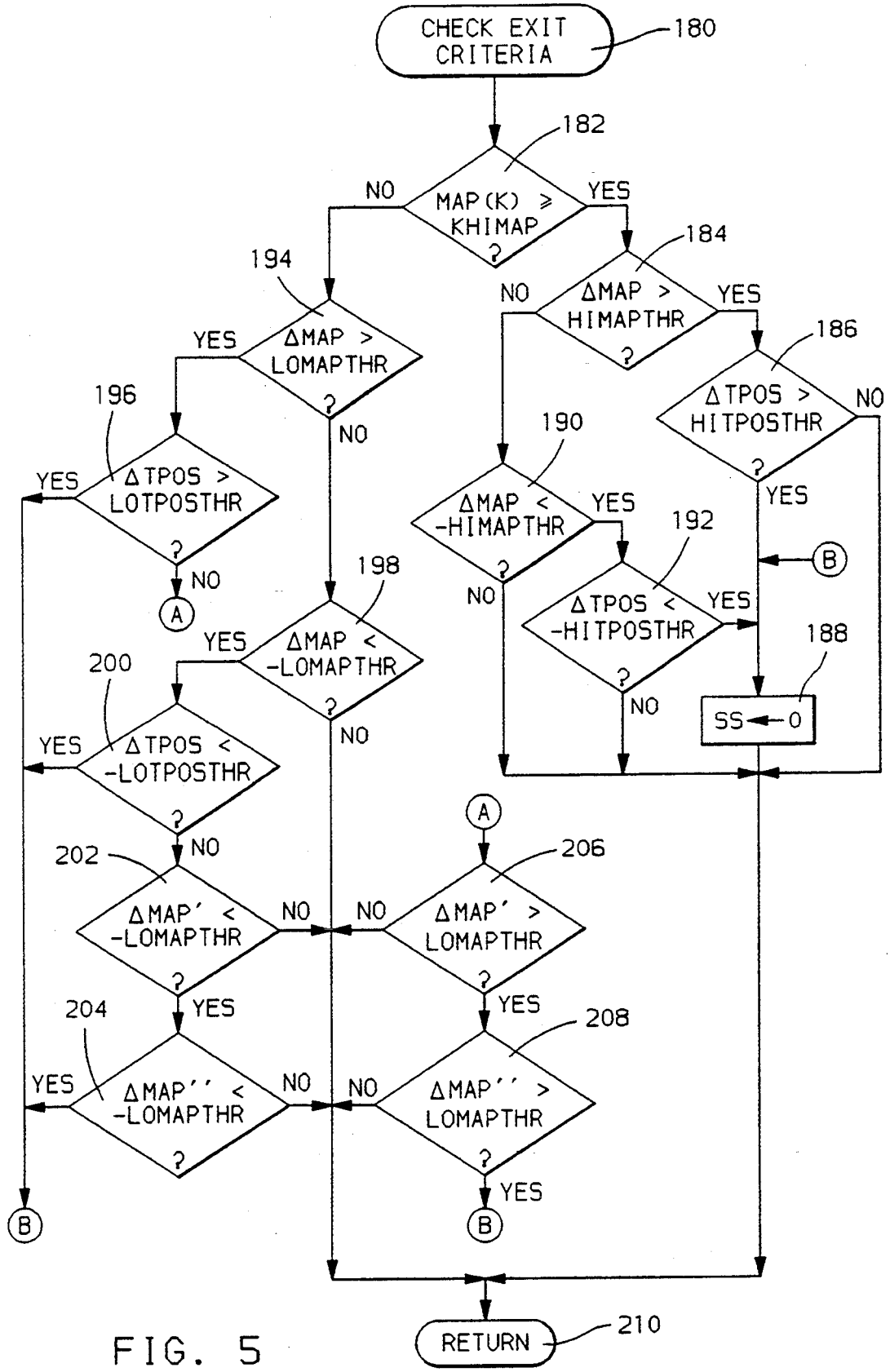

The routine of FIG. 5 illustrates the steps of the present embodiment used to determine if an exit from steady state is justified when already in steady state, under the present engine operating conditions. The criteria are designed to provide a substantially noise immune albeit rapid detection of any engine operating conditions under which accurate cylinder inlet air rate estimation may not be provided through mass airflow sensing alone.

In the present embodiment, two criteria are applied to determine if such conditions are present so a diagnosis of an exit from a steady state condition may be justified. First, diagnosis of an exit is justified if the magnitude of the signal MAP and the magnitude of the signal TPOS are changing in the same direction, such as from a driver-initiated change in engine load. Second, diagnosis of an exit is justified if MAP is drifting up or down, such as from an engine load disturbance. The second criteria are applied only over engine operating ranges in which MAP typically does not drift absent some significant load disturbance.

The two criteria are examined in a manner intended to decrease signal noise sensitivity in a manner consistent with that described for FIG. 4. Specifically, the thresholds compared to the MAP and TPOS signals in the routine of FIG. 5 are made variable. Specifically, for low MAP values a first threshold is applied to MAP and TPOS based values and for large MAP values a second threshold is applied. Such a two tier threshold approach was determined to reduce noise sensitivity after a calibration of the present embodiment of the invention indicated a dependance of signal noise level on MAP magnitude. The inventors do not intend to limit the manner in which the thresholds vary to that of this embodiment. Other variations, such as use of thresholds that vary in response to other known operating conditions may be used within the scope of this invention, if determined through calibration of noise levels and the causes thereof to be necessary for improved noise immunity.

Specifically, the steps used to illustrate the analysis of exit criteria of the present embodiment are called at step 120 of the routine of FIG. 3, and start at step 180 of the routine of FIG. 5. The routine of FIG. 5 moves from step 180 to step 182, to compare MAP(K) to the constant KHIMAP, set to a value consistent with 84 kPa, as described. If MAP(K) exceeds or is equal to KHIMAP, the routine moves to steps 184–192, to check exit criteria using thresholds corresponding to high MAP magnitudes, consistent with the dependence of signal noise on MAP magnitude, as described. Otherwise, the routine moves from step 182 to steps 194–208 to check exit criteria using thresholds corresponding to low MAP magnitudes.

Specifically, if MAP(K) exceeds or is equal to KHIMAP at step 182, the routine moves to a step 184, to compare ΔMAP to high MAP threshold HIMAPTHR, set to a value corresponding to about 0.67 kPa in this embodiment, as described in FIG. 4. If ΔMAP exceeds HIMAPTHR at step 184, the routine moves to step 186 to determine if throttle position TPOS is changing by an amount exceeding its high noise threshold HITPOSTHR in the same direction as MAP is changing above its high noise threshold HIMAPTHR, by comparing ΔTPOS to HITPOSTHR, which is set to approximately 0.5 degrees of throttle valve rotation in this embodiment.

If ΔTPOS exceeds HITPOSTHR at step 186, the routine moves to step 188, to set flag SS to zero, indicating a diagnosed exit from steady state, as the above-described first criteria is satisfied. The routine then returns to the interrupted background operations of FIG. 2, via step 210. Alternatively, if ΔTPOS does not exceed HITPOSTHR at step 186, the routine moves directly to step 210 without changing the status of the SS flag.

Returning to step 184, if MAP is determined to not be increasing in magnitude, such as by ΔMAP not exceeding HIMAPTHR, the routine moves to step 190 to determine if MAP is decreasing by an amount exceeding the applicable noise threshold HIMAPTHR. Specifically, ΔMAP is compared to −HIMAPTHR, if ΔMAP is less than −HIMAPTHR, the routine moves to step 192 to determine if TPOS is likewise decreasing by an amount exceeding its applicable noise threshold HITPOSTHR.

Specifically, if ΔTPOS is less than −HITPOSTHR at step 192, the routine moves to step 188, to clear SS, as described. Otherwise, if ΔMAP is not less than −HIMAPTHR at step 190 or if ΔTPOS is not less than −HITPOSTHR at step 192, the routine moves directly to step 210 without changing the status of the flag SS.

Returning to step 182, if MAP(K) is less than KHIMAP, a second set of thresholds corresponding to calibrated signal noise levels in a low MAP range is applied to the exit criteria analysis, by moving to a step 194, at which ΔMAP is compared to LOMAPTHR, set to zero in this embodiment. LOMAPTHR is calibrated so as to exceed expected noise in the MAP signal while still providing an indication of movement of the MAP signal magnitude.

If ΔMAP exceeds LOMAPTHR at step 194, the routine moves to step 196, to determine if TPOS is changing in the same direction by an amount exceeding its noise threshold LOTPOSTHR, set to zero degrees of throttle valve rotation in this embodiment. At step 196, ΔTPOS is compared to LOTPOSTHR, and if it exceeds LOTPOSTHR, the routine moves to a step 188, to clear SS, as the described exit criteria of MAP and TPOS moving in the same direction is satisfied.

However, if ΔTPOS does not exceed LOTPOSTHR at step 196, the analysis turns to the second criteria: whether MAP is drifting up or down, by moving to steps 206 and 208. These steps analyze whether MAP is consistently drifting up in magnitude over the most recent three MAP samples.

As it was already determined at step 194 that ΔMAP was increasing. Accordingly, at step 206 it is determined whether ΔMAP′ is increasing above the noise threshold LOMAPTHR and at step 208 it is determined whether ΔMAP″ is increasing above the noise threshold. If both steps 206 and 208 indicate an increasing MAP, the routine moves to step 188, to clear SS, as the second exit criteria is met. However, if either of steps 206 or 208 show a non-increasing MAP, the routine moves directly to step 210 without changing SS, as neither the first nor the second exit criteria have been met.

Returning to step 194, if ΔMAP is not greater than LOMAPTHR, the routine moves to a step 198, to determine if MAP is decreasing by an amount exceeding the applicable noise threshold LOMAPTHR, by comparing ΔMAP to −LOMAPTHR. If ΔMAP is not less than −LOMAPTHR at step 198, the routine moves directly to step 210, as no significant change in MAP has been detected in the routine of FIG. 5. Otherwise at step 198, the routine moves to a step 200, to determine if TPOS is likewise decreasing by an amount exceeding its applicable noise threshold LOTPOSTHR, consistent with the described first exit criteria.

Specifically at step 200, ΔTPOS is compared to −LOTPOSTHR. If ΔTPOS is less than −LOTPOSTHR, the routine moves to clear SS at step 188, as the first exit criteria has been met. Otherwise, the second exit criteria are examined by moving to steps 202 and 204. These steps follow from the determination of a decreasing MAP made at step 198.

Steps 202 and 204 determine if that decrease in MAP has been sustained over the last three MAP samples. Specifically, ΔMAP′ must be below −LOMAPTHR at step 202 and ΔMAP″ must be below −LOMAPTHR at step 204 for the second exit criteria to be met, and for the routine to move to step 188 to clear flag SS. If either of these conditions are not met at steps 202 or 204, the routine moves directly to step 210, to exit without changing the status of the flag SS.

The preferred embodiment for the purpose of explaining this invention is not to be taken as limiting or restricting the invention since many modifications may be made through the exercise of skill in the art without departing from the scope of the invention.

The embodiments of the invention in which a property or privilege is claimed are described as follows:

1. A method for detecting transitions between a steady state condition and a transient condition in an internal combustion engine having a plurality of cylinders and an inlet air valve for metering inlet air to an intake manifold, in which inlet air rate to the intake manifold substantially corresponds to inlet air rate to the cylinders in the steady state condition, comprising the steps of:

sensing a first set of engine operating parameters;

sensing a second set of engine operating parameters;

detecting a transition from the steady state condition to the transient condition by (a) determining variations in the magnitude of the sensed first set of engine operating parameters over a first time period, (b) comparing each of the determined variations to a corresponding one of a set of transient noise threshold values, and (c) detecting the transition from the steady state condition to the transient condition when each of the determined variations exceeds the corresponding one of the set of transient noise threshold values; and detecting a transition from the transient condition to the steady state condition by (a) determining variations in the magnitude of the sensed second set of engine operating parameters over a second time period, (b) comparing each of the determined variations to a corresponding one of a set of steady state noise threshold values, and (c) detecting the transition from the transient condition to the steady state condition when each of the determined variations is less than or equal to the corresponding one of the set of steady state noise threshold values.

2. The method of claim 1, wherein the first set of engine operating parameters includes intake manifold air pressure and inlet air valve position.

3. The method of claim 1, wherein the second set of engine operating parameters includes intake manifold air pressure.

4. The method of claim 1, wherein the transient noise threshold values vary as functions of intake manifold air pressure.

5. The method of claim 1, wherein the steady state noise threshold values vary as functions of intake manifold air pressure.

6. A method for detecting transitions between a steady state condition and a transient condition in an internal combustion engine having a plurality of cylinders and an inlet air valve for metering inlet air to an intake manifold, in which inlet air rate to the intake manifold substantially corresponds to inlet air rate to the cylinders in the steady state condition, comprising the steps of:

sensing air pressure in the intake manifold;

sensing inlet air valve position;

detecting a transition from the transient condition to the steady state condition by (a) determining variations in the magnitude of the sensed air pressure in the intake manifold over each of a set of time periods, (b) comparing each of the determined variations to a corresponding one of a set of steady state noise threshold values, and (c) detecting the transition from the transient condition to the steady state condition when each of the determined variations is less than or equal to the corresponding one of the set of steady state noise threshold values; and detecting a transition from the steady state condition to the transient condition by (a) determining a direction of change in magnitude of sensed air pressure over a first time period, (b) determining a direction of change in magnitude of sensed inlet air valve position over a second time period, and (c) detecting a transition from the steady state condition to the transient condition when the direction of change in magnitude of sensed air pressure and the direction of change in magnitude of sensed inlet air valve position are the same direction.

7. The method of claim 6, wherein the step of detecting a transition from the steady state condition to the transient condition further comprises the steps of:

determining variations in the magnitude of the sensed air pressure over the set of time periods;

comparing each of the determined variations to a corresponding one of a set of noise threshold values; and detecting a transition from the steady state condition to the transient condition when each of the determined variations exceed the corresponding one of the set of noise threshold values.

8. The method of claim 7, wherein the set of noise threshold values varies as a function of the sensed air pressure.

9. A method for estimating a rate at which air passes from an intake manifold to cylinders of an internal combustion engine, comprising the steps of:

sensing manifold inlet air rate as a rate at which air passes into the intake manifold;

sensing a first set of engine operating parameters;

sensing a second set of engine operating parameters;

sensing a third set of engine operating parameters;

sensing a transition from a steady state condition, in which the manifold inlet air rate is substantially the same as cylinder inlet air rate, to a transient condition by (a) determining variations in the magnitude of the sensed first set of engine operating parameters over a first time period, (b) comparing each of the determined variations to a corresponding one of a set of transient noise threshold values, and (c) detecting the transition from the steady state condition to the transient condition when each of the determined variations exceeds the corresponding one of the set of transient noise threshold values;

estimating the rate at which air passes from the intake manifold to the cylinders upon sensing the transition from the steady state condition to the transient condition as a function of the third set of engine operating parameters;

detecting a transition from the transient condition to the steady state condition by (a) determining variations in the magnitude of the sensed second set of engine operating parameters over a second time period, (b) comparing each of the determined variations to a corresponding one of a set of steady state noise threshold values, and (c) detecting the transition from the transient condition to the steady state condition when each of the determined variations is less than or equal to the corresponding one of the set of steady state noise threshold values; and estimating the rate at which air passes from the intake manifold to the cylinders upon sensing the transition from the transient condition to the steady state condition as a function of the sensed manifold inlet air rate.

10. The method of claim 9, wherein the first set of engine operating parameters includes intake manifold air pressure and air inlet valve position.

11. The method of claim 9, wherein the second set of engine operating parameters includes intake manifold air pressure.

12. The method of claim 9, wherein the third set of engine operating parameters includes intake manifold air pressure, manifold air temperature, air inlet valve position, and engine speed.

13. The method of claim 9, wherein each of the set of steady state noise threshold values varies as a corresponding function of a engine operating parameter.

14. The method of claim 13, wherein the engine operating parameter is intake manifold air pressure.

15. The method of claim 9, wherein each of the set of transient noise threshold values varies as a corresponding function of a engine operating parameter.

16. The method of claim 15, wherein the engine operating parameter is intake manifold air pressure.

* * * * *